United States Patent [19]

Holt

[11] 3,981,319

[45] Sept. 21, 1976

[54] CYCLING AIR VOLUME CONTROL

[75] Inventor: Corbly LeRoy Holt, Clearwater, Fla.

[73] Assignee: Brady Air Controls, Inc., Muncie, Ind.

[22] Filed: May 5, 1975

[21] Appl. No.: 574,580

[52] U.S. Cl. ..... 137/211; 417/2

[51] Int. Cl.[2] ..... F04D 1/00

[58] Field of Search ..... 137/211.5, 211, 209; 417/2

[56] References Cited

UNITED STATES PATENTS 3,053,435 9/1962 Sanders ..... 137/211.5 X 3,805,820 4/1974 Brady ..... 137/211.5

*Primary Examiner*—Alan Cohan

*Attorney, Agent, or Firm*—Woodard, Weikart, Emhardt & Naughton

[57] ABSTRACT

In an air pressurized hydraulic system, air is replenished in a storage tank for the liquid by an air control responsive to pressure differences in the system to supply air to the storage vessel if needed. During replenishment of liquid in the storage vessel, air may be added repetitively by periodically switching a valve to reverse the pressure across an air control chamber device for admission of air from atmosphere and discharge into the pressure vessel.

19 Claims, 7 Drawing Figures

CYCLING AIR VOLUME CONTROL

BACKGROUND OF THE INVENTION

1. Field of the Invention

This invention relates generally to liquid supply systems, and more particularly to means for adequately replenishing air which is adsorbed or absorbed by a liquid in a storage vessel pressurized by air.

2. Description of the Prior Art

Air controls for hydropneumatic systems are well known for replenishing air in the water storage tank to make up for that which is absorbed by water eventually used in the system supplied by the tank. Examples of such air controls can be found in United States patents as follows:

| Patent No. | Issue Date | Inventor |
|---|---|---|
| 2,183,421 | Dec. 12, 1939 | Francis E. Brady |
| 2,622,531 | Dec. 23, 1952 | Francis E. Brady, Jr. |
| 2,709,964 | June 7, 1955 | Francis E. Brady, Jr. |
| 3,133,501 | May 19, 1964 | Richard F. Brady |
| 3,805,820 | April 23, 1974 | Francis E. Brady, Jr.<br>Corbly Leroy Holt<br>Theodore W. Walker |

Some other patents describing means for introducing air to a tank are included in the following group of U.S. patents:

| Patent No. | Issue Date | Inventor |
|---|---|---|
| 2,578,050 | Dec. 11, 1951 | Deters |
| 2,793,650 | May 28, 1957 | Kracht |
| 2,873,758 | Feb. 17, 1959 | Nielsen |
| 2,971,464 | Feb. 14, 1961 | Stevens |
| 3,053,435 | Sept. 11, 1962 | Sanders |
| 3,088,412 | May 7, 1963 | Good |
| 3,171,351 | March 2, 1965 | Shelter |
| 3,207,076 | Sept. 21, 1965 | Morgan |
| 3,259,067 | July 5, 1966 | Bryan |
| 3,269,318 | Aug. 30, 1966 | Telford |
| 3,297,236 | Jan. 10, 1967 | Eckerle |
| 3,318,324 | May 9, 1967 | Ruth |

In this group of patents, it appears that the Sanders patent may be pertinent to my idea of repetitively adding air to a tank if needed during pump operation, but in the Sanders patent it is done by using a single cylinder motor-pump by which the motor drives an air pump to pump air into the tank when the float in the tank indicates a need for air.

In the Telford patent, while there is provision for continuously adding air to the tank if needed while the pump is running, it relies on a pulsating main water supply pump. It states that any means for providing pulses to the air injector will be suitable, but does not elaborate.

In many systems, it is sufficient to add air only once during the pump operating cycle; that is, between the time the pump starts and the pump next starts. Of course, this requires an adequate sized air charging device and such becomes extremely difficult if the particular liquid employed has an extremely great affinity for water. For example, in some systems where oil is used, the absorption rate is extremely high, thus necessitating either large air charging devices, or a number of them operating in parallel, in order to achieve the necessary addition of air to avoid loss of the air cushion in the oil storage vessel. An example of a system in which some improvement is needed is disclosed in U.S. Pat. No. 3,673,614, issued July 4, 1972 to R. W. Claunch of New Orleans, La. There is also needed some means for providing the needed additional air in existing or new systems conveniently, regardless of the type of pump employed, particularly for water systems. The present invention is addressed to solving these various needs.

SUMMARY OF THE INVENTION

Described briefly, in a typical embodiment of the present invention, a switchable valve is combined with the air volume control chamber and pump and operable continuously on a timed basis during pump operation to add air as needed during that period.

DESCRIPTION OF THE PREFERRED EMBODIMENT

Figure 1:
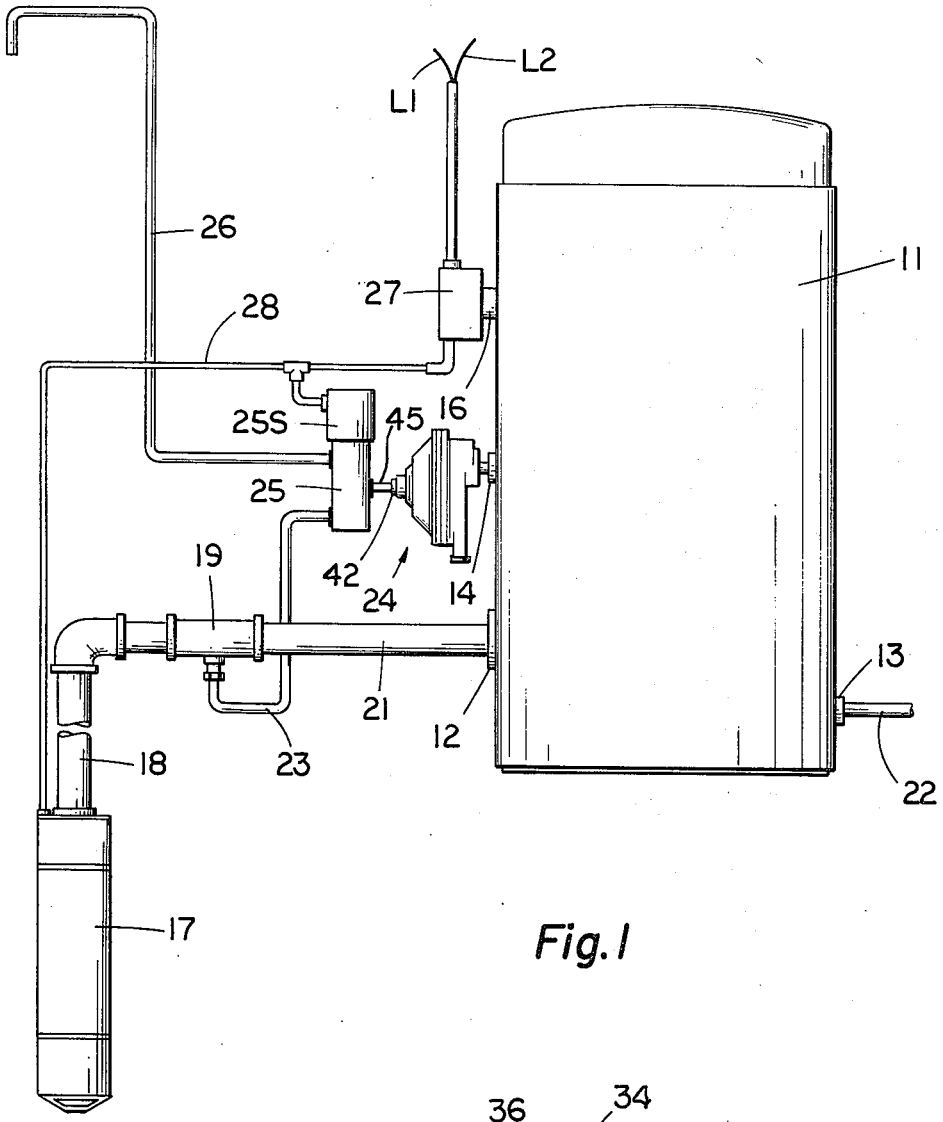
FIG. 1 is an elevational view of a hydropneumatic system incorporating a typical embodiment of the present invention and a submersible pump.

Referring now to the drawings in detail, and particularly to FIG. 1, a water storage tank 11 is provided with fittings 12, 13, 14, and 16 for a water inlet, outlet, air control connection, and pressure switch, respectively. An electric pump 17 of the submersible type can supply water from a well through the piping 18 and through an actuator valve body 19 and inlet pipe 21 to the tank 11. The outlet pipe 22 is connected to the water using system. This may be in a residence, for example. An air control line 23, normally containing water, is connected between the actuator body 19 and the air control chamber assembly 24 with valve 25 interposed therebetween according to my invention as will more fully appear hereinafter. A drain tube 26 is connected to valve 25 and may be directed to a suitable drain line or ditch, for example. The pressure switch 27 is connected by suitable electric conductors in conduit 28 to the pump 17. The pressure switch is responsive to pressure in the tank to turn on the pump when the pressure gets below a certain predetermined level such as 20 pounds per square inch gauge (PSIG) for example, and stop the pump when the pressure has risen to 40 PSIG, for example. The drain tube outlet may be above the top of the tank in a manner described in more detail in above-mentioned U.S. Pat. No. 3,805,820.

Figure 2:
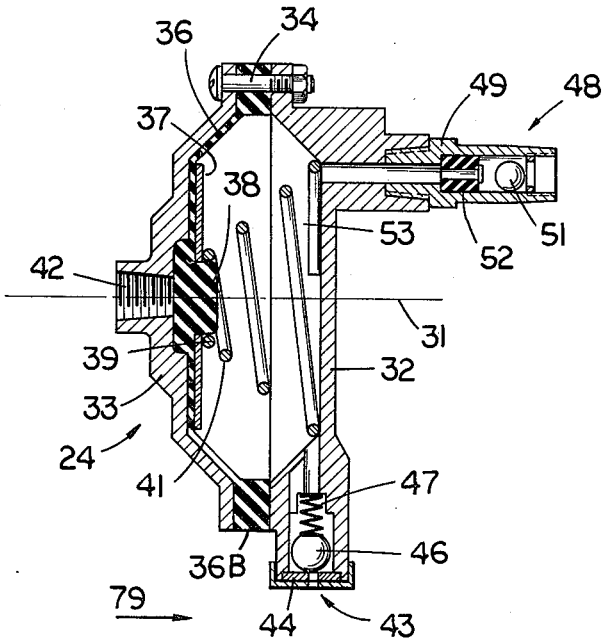
FIG. 2 is a vertical section through the air control chamber assembly of FIG. 1.

Referring now to FIG. 2, the air chamber assembly is a generally circular unit about a central axis 31 including a mounting shell 32 and cover shell 33 which are secured together by a series of circularly spaced bolts 34 received through apertures in the flanges of the respective shells. A diaphragm 36 is sandwiched between the flanges of the shells, and is flexible to conform to the interior contour of the shells, and particularly outer shell 33 when urged against it by a disc 37 having an aperture receiving a boss 38 on the inner face of the diaphragm serving as a pilot for a small end turn 39 of a coil spring 41, the large turn of which is seated in the mounting shell 32. This air control spring 41 normally urges the diaphragm against the inner wall of the outer shell 33 closing the port 42 to which the line 45 from valve 25 (FIG. 1) is connected. Notice that the portion of the diaphragm spanning the chamber extends from a thicker mounting portion 36B sandwiched between the circumferential flanges of the shells. The spanning portion is flush with the outer shell 33. The extra space thereby provided on the air chamber side of the diaphragm, permits it to completely invert during operation.

The air control mounting shell 32 has a snifter valve 43 therein including a seat 44, check ball 46, and spring 47. The spring normally holds the ball against the seat.

The mounting shell also has a water check valve assembly 48 in the fitting 49 by which it is mounted to the fitting 14 of the tank. The water check valve includes a floatable ball 51 which will normally rest below the center of the seat 52, and not close on the seat 52 unless water has risen to or above that level in the tank, tending to help the ball to seat. Thus this check valve will accommodate passage of air back and forth through it, but will preclude the passage of water from the tank into the air chamber 53 of the air control assembly 24.

Figure 3:
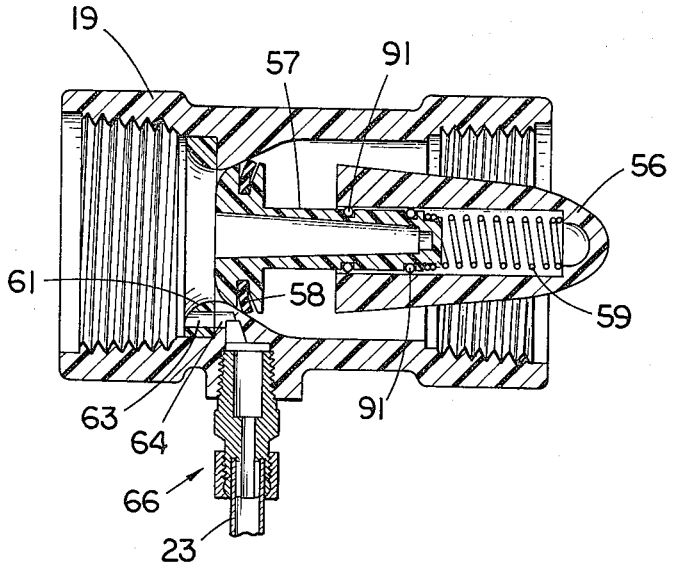
FIG. 3 is a vertical section through an actuator valve assembly employed in FIG. 1.

Referring now specifically to FIG. 3, the actuator body 19 includes therein an axially located, streamlined and stationary diffuser 56 receiving the stem of the actuator poppet 57 having a circular "dead" rubber (typically butyl rubber) seal 58 thereon and loaded by the actuator spring 59. When the pump is off, this valve is in the closed position shown. O-rings 91 avoid chatter.

A streamlining arch 61 is tightly fitted and stationary in the actuator body immediately upstream of the poppet valve seat and extends through an arc of 360°. It has a passageway 63 communicating with passageway 64 in valve body 19, communicating with control line 23 through the compression fitting assembly 66.

Figure 4:
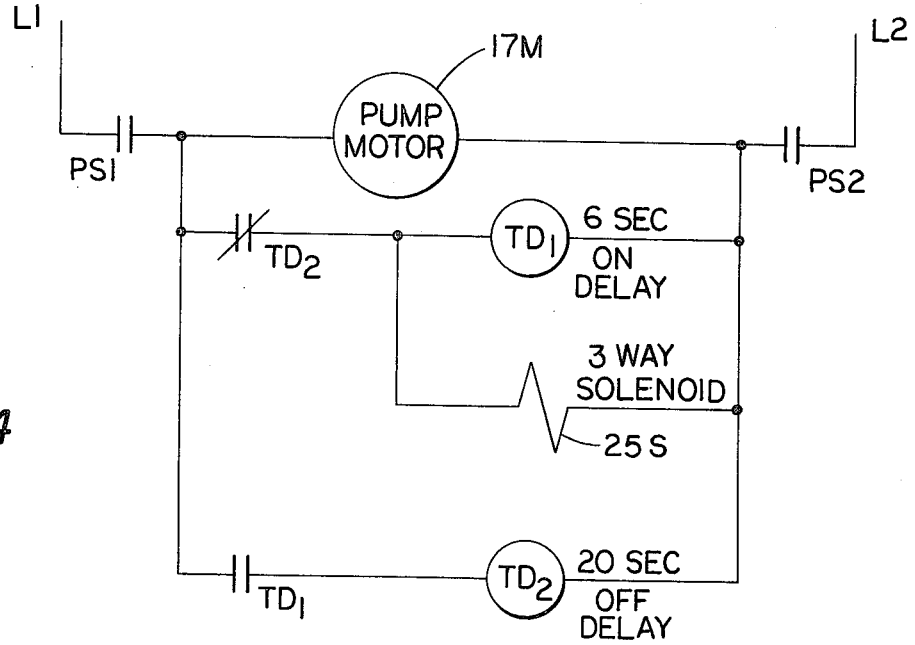
FIG. 4 is an electrical schematic diagram.

Referring again to FIG. 1, together with FIG. 4, valve 25 is shown as a solenoid-operated three-way valve which, when the solenoid 25S thereof is energized, provides an open path between pressure line 23 and line 45 to the control fluid inlet 42 of the air control chamber assembly 24. The drain line 26 is blocked. When the solenoid is de-energized, an open path is provided between the inlet 42 and the drain line 26, and line 23 is blocked. This solenoid is connected across the motor leads as is best shown in FIG. 4 where the electrical supply lines L1 and L2 are fed to the pump motor 17M through the normally open pressure switch contactors PS1 and PS2. These contactors should be understood to be in the pressure switch 27 of FIG. 1. The combination of the solenoid winding 25S, and the normally closed relay contacts TD2 is in parallel with the motor input leads. The combination of the operating coil of relay TD2 in series with the normally open contacts TD1 of another time delay relay, is in parallel with the motor leads. The relay operating coil TD1 is in parallel with the solenoid winding 25S.

OPERATION

In the operation of the system, assuming that the storage tank is empty, the pressure switch 27 will respond to the absence of pressure in the tank, and close the contactors PS1 and PS2 thereof to provide power from the input lines L1 and L2 to the pump motor and thus energize the pump 17, which commences to pump water from the well. As soon as the pressure upstream of the actuator poppet 57 in FIG. 2 rises sufficiently to overcome the closing force thereon applied by spring 59, the actuator poppet will open and admit water through the fill line 21 into the tank 11. At the same time the pump motor is energized, the solenoid coil 25S is energized, which shifts the valve 25 to block drain line 26 and provide communication between the chamber assembly 24 and pressure line 23. Water in line 23 from the pump can then enter the inlet 42 of the air control chamber assembly and drive the diaphragm 36 thereof to the right toward the tank, whereupon air in the chamber to the right of the diaphragm will be forced into the tank in the direction of arrow 79 (FIG. 2).

After 6 seconds, the relay coil TD1 will close contacts TD1 thereof, thereupon energizing relay coil TD2 which immediately opens the contact TD2 thereof, de-energizing solenoid coil 25S. The solenoid valve then shifts, whereby the drain line 26 is in communication through the valve 25 with the air chamber inlet 42, and the pressure line 23 is blocked. Relay TD2 is an "off-delay" relay so this condition will be maintained for 20 seconds. Thus, for 20 seconds, with the drain line communicating through valve 25 with the aperture 42 in the control chamber assembly, the spring can force the diaphragm away from the tank to the position shown in FIG. 2, thus forcing all of the water out of the chamber and out the drain line 26. After 20 seconds, with the pump still running, the "off-delay" relay contacts TD2 automatically reclose, whereupon the solenoid coil 25S is again energized to open pressure line 23 and block the drain 26.

During this initial period, each time the solenoid valve shifts and the spring moves the diaphragm to the left, the water level in the tank has not risen high enough to float the check ball 51 against the seat 52 (FIG. 2) so air will again enter the chamber to the right of the diaphragm from the water tank. Normally the pressure in the tank will rise sufficiently to shut off the pump prior to the time the water rises to the level where it can float the ball 51 against the seat 52. When the pump does stop, the solenoid, being de-energized, will leave inlet 42 in communication with drain line 26 through the valve 25 allowing spring 41 (FIG. 2) to move diaphragm 36 against the left hand wall of the chamber assembly assisted by the pressure in the tank.

Whenever so much air from above the water in the tank has been absorbed, that the water level is above the level of the float ball 51 in the air control chamber assembly, the ball will seal against seat 52 every time the solenoid valve is de-energized and, as the spring pushes the diaphragm away from the tank, the snifter valve assembly 43 will open as the atmospheric pressure pushes the ball 46 off seat 44, admitting air from atmosphere. Then, when the solenoid is energized, pump pressure on line 23 will drive the diaphragm to the right against the spring force and tank pressure to discharge the air from the air chamber assembly through the check ball 51 and inject it into the water storage tank. The time it will take for this to be accomplished will depend on the pressure drop established by the drop across the actuator valve assembly 19, and the strength of the spring 41. This pressure drop may be 5 pounds per square inch (PSI) for example. If it should happen that within the pressure range of operating pressures of the tank and the various other components, the air injecting time needed would be more than 6 seconds, the TD1 relay could be chosen or modified accordingly to provide the additional time needed before shifting the valve to open the drain. It is important that the time be adequate for the pressure differential across the diaphragm to urge the diaphragm as completely as possible against the inner wall of mounting shell 32, to drive virtually all of the air out of chamber 53 into the tank so that, when the solenoid valve shifts, and check ball 51 closes, the amount of air in chamber 53 expanding to the atmospheric pressure or less, will be extremely small. This will enable entry of sufficient air through the snifter valve for the next injection into the tank.

It should be recognized immediately that this invention can be applied to the air-over-oil supply system disclosed in the above-mentioned U.S. Pat. No. 3,673,614, and can be particularly beneficial in that system for the reason that it enables the use of a comparatively small air control assembly or one of standard size but with an air charging capability which is far in excess of that which it would have under normal circumstances where the charging takes place only once during a pump operating cycle, either when the pump is turned on or when the pump is turned off.

Figure 5:
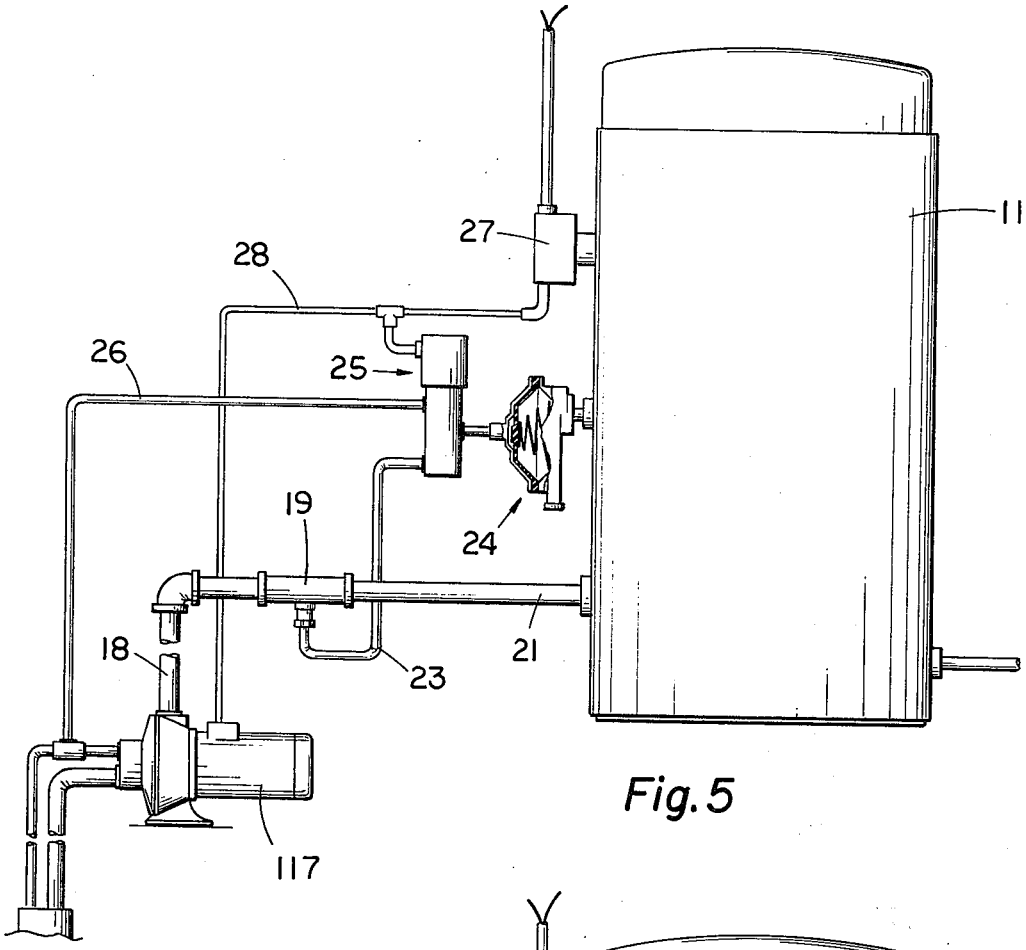
FIG. 5 is an elevational view of a hydropneumatic system using a low-vacuum, high-pressure deepwell jet pump with a typical embodiment of the present invention.

Referring now to FIG. 5, the same reference numerals are used as in FIG. 1 to show corresponding components. However, in this embodiment the drain line 26 is connected to a vacuum tap on the deepwell jet pump 117. The control is achieved in the same manner as in the embodiment of FIG. 1.

Figure 6:
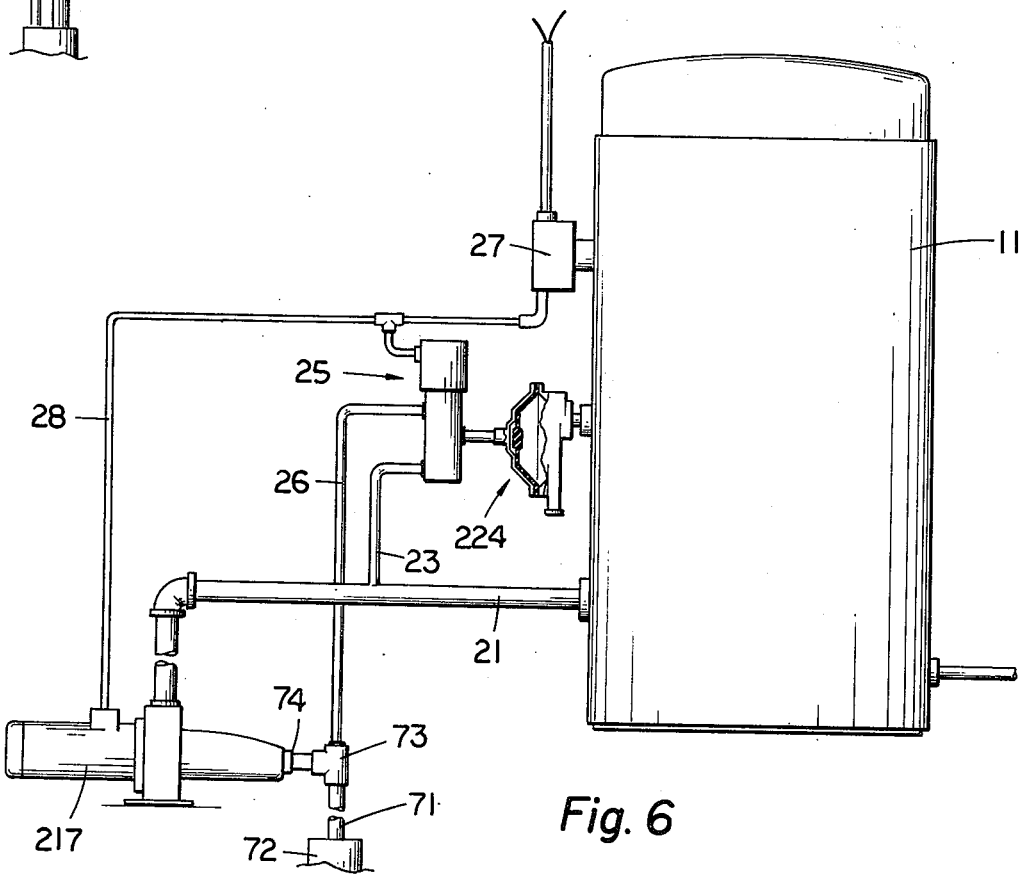
FIG. 6 is an elevational view of a hydropneumatic system employing a conventional vacuum-creating centrifugal pump with a typical embodiment of the present invention.

Referring now to FIG. 6, the air control assembly in this embodiment is different in the respect that no springs are employed. Thus it is given the reference numeral 224. This is for the reason that the pump 217 is a centrifugal pump of the type which creates a vacuum at the eye of the impeller and to which the suction line 71 is connected and which extends into the well 72. In this instance, the drain line 26 from the valve 25 is connected to the suction line 71 at the junction 73 which is, in turn, connected to the pump suction port at 74.

In this embodiment of the cycling air volume control, which may be considered the "Type B" in contrast to "Type A" described with reference to FIGS. 1 and 5, the pressure differential created by frictional losses between the pump and the tank is sufficient (0.5 to 2 PSI) to push the diaphragm against the tank side of the air control chamber assembly 224 when the solenoid for valve 25 is energized and thus inject air into the tank. When the timer de-energizes the solenoid, to reverse the three-way valve 25, it is necessary that there be a vacuum to draw the diaphragm back away from the tank and against the wall of the air chamber assembly 224 as shown in FIG. 6, to draw in more air through the snifter valve. The connection of the drain line 26 from the valve 25 to the pump vacuum port 74 at the eye of the impeller provides this vacuum. Accordingly, in this embodiment also, as the pump runs, the timer causes the shifting of valve 25 and, if the water level in the tank is above the check ball in the air control attachment to the tank, air will be injected repetitively into the tank so long as the pump motor is energized. If the water level in the tank is below the level-sensing check ball in the air control assembly, air will simply be shuttled back and forth between the tank side of the diaphragm and the interior of the tank itself.

Figure 7:
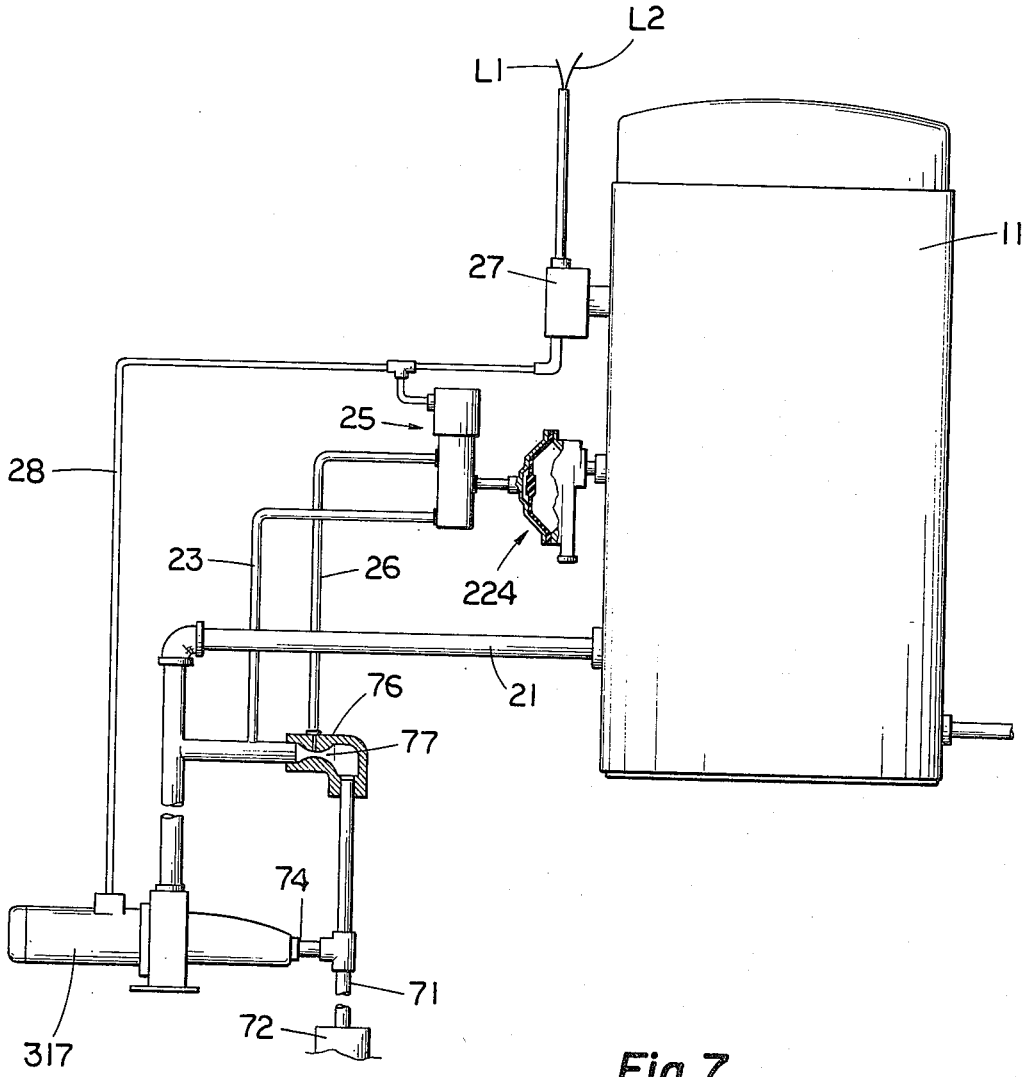
FIG. 7 is an elevational view of a hydropneumatic system employing a low-vacuum type of centrifugal pump together with a vacuum-producing jet and a typical embodiment of the present invention.

FIG. 7 illustrates another arrangement in which the pump 317 is of a type which does not produce as great a vacuum at the suction port 74, as the pump in FIG. 6. In this instance, auxiliary means are provided to provide an adequate amount of vacuum for connection into the drain line 26 from valve 25. This is accomplished by providing a Venturi assembly 76 connected between the pressure port and suction port of the pump and producing adequate vacuum at the restriction through port 77 to the drain line 26. This "Posi-Vac" device marketed by the assignee of the present application, is useful for this purpose. Apart from this additional feature included to provide the amount of vacuum needed, this embodiment functions in basically the same way as that in FIG. 6.

From the foregoing description, it will be recognized that the present invention can be employed very well on systems using liquids other than water, and a system such as that described in the aforementioned U.S. Pat. No. 3,673,614 is one example of such system. Therefore, it should be understood that only the preferred embodiment has been shown and described and that all changes and modifications that come within the spirit of the invention are desired to be protected.

What is claimed is:

1. A cycling air volume control for an air-pressurized hydraulic system comprising:

an air storage chamber assembly including a housing having a cavity therein for a control fluid therein and air therein, the respective volume of fluid and air therein being variable, first aperture means in said housing to permit entrance of air to said cavity from atmosphere, second aperture means in said housing to permit entrance and departure of said control fluid, and third aperture means in said housing to permit discharge of air therefrom to a liquid storage vessel;

and switchable valve means having an operating energy source independent of energy stored in the liquid storage vessel, said switchable valve means being coupled to said second aperture of said storage chamber assembly and operable to periodically change fluid passages and communicating with said second aperture to enable periodically changing a pressure difference between said second and third aperture means to thereby periodically vary the respective volumes of fluid and air in said air storage chamber assembly.

2. A cycling air volume control for an air-pressurized hydraulic system comprising:

an air storage chamber assembly including a housing having a cavity therein for a control fluid therein and air therein, the respective volume of fluid and air therein being variable, first aperture means in said housing to permit entrance of air to said cavity from atmosphere, second aperture means in said housing to permit entrance and departure of said control fluid, and third aperture means in said housing to permit discharge of air therefrom to a liquid storage vessel;

and switchable valve means coupled to said second aperture of said storage chamber assembly and operable to periodically change fluid passages and communicating with said second aperture to enable periodically changing a pressure difference between said second and third aperture means to thereby periodically vary the respective volumes of fluid and air in said air storage chamber assembly, and said switchable valve means including a valve driving solenoid and electric timer means having electric input means for connection to electric input means for an electrically-driven hydraulic system pressurizing pump for energization of said timer means whenever said pump is energized, said timer means controlling energization of said solenoid and periodically de-energizing said solenoid during the period when said timer means are energized, for periodically switching said valve.

3. The control of claim 2 wherein:

said timer means includes means for energization and de-energization of said solenoid periodically.

4. The control of claim 3 wherein:

said timer means includes first and second electrically operable switches, each of said switches having contactor means and operating coil means therefor;

said operating coil means of said first switch and normally closed contactor means of said second switch being connected in a first series combination for connection across input conductors to said pump and said operating coil means of said second switch and normally open contactor means of said first switch being connected in a second series combination for connection across input conductors, said solenoid being connected in a third series combination with said normally closed contactor means of said second switch for control of said solenoid by said normally closed contactor means, said operating coil means of said second switch being operable to open the normally closed contactor means of said second switch upon application of energy to the operating coil means therefor but delay closure of said contactor means for a second pre-determined time.

5. The control of claim 4 and further comprising:

a pressure responsive switch having input conductors for connection to a source of electrical energy and output conductors for connection to a load, and pressure switch contactor means between said input and output conductors and operable upon sensing a pressure below a first pre-determined pressure level to close said contactor means and make electrical connection between certain of said input and output conductors, said series combinations being connected across said output conductors.

6. The control of claim 2 and further comprising:

pressure differential establishing means having means for conveying liquid therethrough to establish a pressure differential therein, and having a connection to said switchable valve means.

7. The control of claim 6 wherein:

said switchable valve means includes first, second, and third ports, and is operable in one condition to provide communication between said first and second ports and block said third port, and in another condition to provide communication between said first and third ports and block said second port, said first port being connected to said second aperture means in said air storage chamber assembly.

8. The control of claim 7 wherein:

said pressure differential establishing means includes a valve having an upstream and downstream side, said connection being a conduit from the upstream side to said third port of said switchable valve means.

9. The control of claim 7 wherein:

said pressure differential establishing means includes a venturi having a low pressure tap, said connection being a conduit from said low pressure tap to said second port of said switchable valve means.

10. The control of claim 7 wherein:

said air storage chamber assembly has a movable wall in said cavity, dividing said cavity into a control fluid chamber and an air chamber, said second aperture means communicating with the control fluid chamber.

11. The control of claim 10 wherein:

said air storage chamber assembly has a one-way snifter valve connected to said first aperture means and a float operable check valve connected to said third aperture means to prevent flow through said third aperture means into said air chamber when liquid is at said float operable check valve.

12. The combination of claim 10 and further comprising:

a closed liquid storage vessel having a liquid therein and air over the liquid, said third aperture means of said air storage chamber assembly communicating with the interior of said vessel and accommodating passage of air back and forth between said air chamber and vessel, said pressure differential establishing means including an electrically-driven, system pressurizing pump having a high pressure outlet coupled to said vessel for supplying liquid to said vessel and thereby pressurizing said vessel, said pump having electric input means for energization thereof and connected to the electric input means of said timer means for energization of said timer means when said pump is energized.

13. The combination of claim 12 wherein:

said pressure differential establishing means further includes a liquid check valve assembly including a valve body with a one-way check valve therein, said valve body providing a passageway for liquid from said high pressure outlet of the pump to said vessel and oriented for the check valve therein to be movable in a downstream direction toward said vessel to open, said connection being a conduit from the upstream side of said check valve to said third port of said switchable valve means to apply pump pressure to the control fluid chamber of said air storage chamber assembly when said switchable valve means is in said another condition to drive said movable wall and expel air from said air chamber into said storage vessel.

14. The combination of claim 13 and further comprising:

a drain line to atmosphere connected to said second port.

15. The combination of claim 13 and further comprising:

a low pressure inlet at said pump;

and a suction line connected between said second port and low pressure inlet.

16. The combination of claim 12 wherein:

said pump has said high pressure outlet connected to said third port, and said pump has a low pressure inlet connected to said second port of said switchable valve means.

17. The combination of claim 12 wherein:

said pump has said high pressure outlet connected to said third port, said pump has a low pressure inlet, and said pressure differential establishing means includes a venturi having an inlet connected to said high pressure outlet and an outlet connected to said low pressure inlet, and a low pressure tap connected to said second port of said switchable valve means.

18. The combination of claim 12 and further comprising:

storage vessel pressure responsive switch means coupled to said liquid storage vessel and having energy source input means for connection to a source of electrical energy, and having output means connected to said electric input means for said pump and said timer means, and responsive to vessel pressure below a first pre-determined level to connect said energy source input means to said electric input means to energize said pump and said timer means, and responsive to pressure above a second pre-determined level to disconnect said energy source input means from said electric input means to de-energize said pump and timer means.

19. The combination of claim 18 wherein:

said timer means are arranged to cause energization and de-energization of said solenoid for switching said switchable valve means a plurality of times during pump operation between the energization effected at said first pressure level and de-energization effected at said second pressure level.

* * * * *